US007274269B2

(12) United States Patent
Nakabayashi et al.

(10) Patent No.: US 7,274,269 B2
(45) Date of Patent: Sep. 25, 2007

(54) WAVEGUIDE TRANSMISSION LINE CONVERTER WHERE THE OPEN END OF THE WAVEGUIDE HAS A BEVELED INNER CORNER

(75) Inventors: Kent Nakabayashi, Nisshin (JP); Tetsuya Katayama, Nisshin (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 11/156,340

(22) Filed: Jun. 17, 2005

(65) Prior Publication Data

US 2005/0280480 A1 Dec. 22, 2005

(30) Foreign Application Priority Data

Jun. 18, 2004 (JP) ..... 2004-181085

(51) Int. Cl.
*H01P 5/107* (2006.01)

(52) U.S. Cl. ..... 333/26; 333/34

(58) Field of Classification Search ..... 333/26, 333/34

See application file for complete search history.

(56) References Cited

U.S. PATENT DOCUMENTS 5,539,361 A * 7/1996 Davidovitz ..... 333/26
6,396,363 B1 * 5/2002 Alexanian et al. ..... 333/26
6,580,335 B1 6/2003 Iizuka et al.
2004/0119554 A1 6/2004 Tahara et al.

FOREIGN PATENT DOCUMENTS

| | | |
|---|---|---|
| JP | 10-126114 | 5/1998 |
| JP | 2002-359508 | 12/2002 |
| JP | 2003-273612 | 9/2003 |

* cited by examiner

*Primary Examiner*—Benny Lee
(74) *Attorney, Agent, or Firm*—Harness, Dickey & Pierce, PLC

(57) ABSTRACT

A waveguide-transmission line converter has a waveguide including side walls which have inner corners at an open end of the waveguide. The inner corners are beveled to provide tapered inner surfaces. Even if a dielectric substrate is assembled out of alignment with the waveguide due to an assembling error, edges of a ground metal layer on the dielectric substrate are exposed from the beveled inner corners at the open end of the waveguide. The beveled inner corners keep the waveguide spaced widely from edges of a matching element on the dielectric substrate, preventing an electric field concentration from occurring between the waveguide and the matching element. The waveguide-transmission line converter has electromagnetic energy passing and reflecting characteristics prevented from varying.

16 Claims, 16 Drawing Sheets

WAVEGUIDE TRANSMISSION LINE CONVERTER WHERE THE OPEN END OF THE WAVEGUIDE HAS A BEVELED INNER CORNER

CROSS-REFERENCE TO RELATED APPLICATIONS

This application is based upon and claims the benefits of priority from the prior Japanese Patent Application No. 2004-181085, filed on Jun. 18, 2004, the entire contents of which are incorporated herein by reference.

BACKGROUND OF THE INVENTION

1. Field of the Invention

The present invention relates to a waveguide-transmission line converter for converting electromagnetic energy in microwave or millimeter wave regions of the electromagnetic spectrum between a waveguide and a transmission line.

2. Description of the Related Art

Conventional waveguide-transmission line converters are known from Japanese laid-open patent publication No. 2002-359508 and Japanese laid-open patent publication No. H10-126114, for example.

The waveguide-transmission line converters disclosed in the above publications will be described below with reference to FIGS. 1(*a*) through 1(*d*) and 2(*a*) through 2(*d*) of the accompanying drawings.

FIGS. 1(*a*) through 1(*d*) show a patch-resonator waveguide-transmission line converter as disclosed in Japanese laid-open patent publication No. 2002-359508. FIG. 1(*a*) is a perspective view of the patch-resonator waveguide-transmission line converter, FIG. 1(*b*) a cross-sectional view of the patch-resonator waveguide-transmission line converter, FIG. 1(*c*) a plan view of the waveguide-transmission line converter, and FIG. 1(*d*) a bottom view of a dielectric substrate of the patch-resonator waveguide-transmission line converter.

As shown in FIGS. 1(*a*) through 1(*d*), the patch-resonator waveguide-transmission line converter has an elongate rectangular dielectric substrate J1 with a stripline J2, FIGS. 1(*a*)-1(*c*), disposed on one surface thereof, and a waveguide J3, FIGS. 1(*a*) & 1(*b*), mounted on the dielectric substrate J1 with a ground metal layer J4, FIGS. 1(*b*) & 1(*d*), interposed between the dielectric substrate J1 and the waveguide J3. The ground metal layer J4 is in the form of a centrally open rectangular frame having a width which is substantially the same as the thickness of the side walls of the waveguide J3.

The patch-resonator waveguide-transmission line converter also has a short-circuit plate J5, FIGS. 1(*a*)-1(*c*), fixedly mounted on the surface of the dielectric substrate J1 remotely from the waveguide J3. The short-circuit plate J5 has an outer profile which is substantially the same as the outer profile of the rectangular dielectric substrate J1. The short-circuit plate J5 has a recess defined centrally therein which is open at a longitudinal side edge thereof. With the short-circuit plate J5 fixedly mounted on the dielectric substrate J1, the stripline J2 is disposed in and exposed from the recess.

A matching element J6 FIG. 1(*b*) & 1(*d*) which comprises a substantially square metal layer is mounted centrally on the other surface of the dielectric substrate J1 remote from the stripline J2. The matching element J6 is spaced a predetermined distance from the stripline J2 and the short-circuit plate 5, and electromagnetically coupled to the stripline J2 across the dielectric substrate J1.

FIGS. 2(*a*) through 2(*d*) show a back-short waveguide-transmission line converter as disclosed in Japanese laid-open patent publication No. H10-126114. FIG. 2(*a*) is an exploded perspective view of the back-short waveguide-transmission line converter, FIG. 2(*b*) a cross-sectional view of the back-short waveguide-transmission line converter, FIG. 2(*c*) a plan view of the back-short waveguide-transmission line converter, and FIG. 2(*d*) a bottom view of a dielectric substrate of the back-short waveguide-transmission line converter.

As shown in FIGS. 2(*a*) through 2(*d*), the back-short waveguide-transmission line converter has a rectangular dielectric substrate J11 with a stripline J12, FIGS. 2(*a*)-2(*c*), disposed on one surface thereof, and a waveguide J1 having an opening defined in an end thereof. The dielectric substrate J11 is mounted on the open edge of the waveguide J13 is with a ground metal layer J14, FIGS. 2(*a*), 2(*b*) & 2(*d*), interposed between the dielectric substrate J11 and the open edge of the waveguide J13. The back-short waveguide-transmission line converter also has a short-circuit waveguide block J15, FIGS. 2(*a*) & 2(*b*) mounted on the open edge of the waveguide J13, with the dielectric substrate J11 positioned therebetween.

The conventional waveguide-transmission line converters shown in FIGS. 1(*a*) through 1(*d*) and 2(*a*) through 2(*d*) are capable of exchanging electromagnetic energy transmitted by the waveguides J3, J13 electromagnetic energy transmitted by the striplines J2, J12, respectively with each other.

Waveguide-transmission line converters should desirably be able to pass electromagnetic energy at a high ratio with minimum energy reflection in order to allow the electromagnetic energy transmitted by the waveguide and the electromagnetic energy transmitted by the transmission line to be exchanged with each other at a low energy loss.

Waveguide-transmission line converters have their electromagnetic energy passing and reflecting characteristics variable depending on the frequency of the electromagnetic energy that is converted by the waveguide-transmission line converter. If a waveguide-transmission line converter is applied to convert electromagnetic energy in the millimeter wave range, then since the electromagnetic energy has a frequency in the range from 76 to 77 GHz, for example, the waveguide-transmission line converter should desirably be able to pass electromagnetic energy at a high ratio with low energy reflection in that frequency range.

However, it has been confirmed that the conventional waveguide-transmission line converters disclosed in the above publications are problematic in that they fail to pass electromagnetic energy at a high ratio with low energy reflection due to assembling errors. This problem will be described below with reference to FIGS. 3(*a*), 3(*b*), and 4(*a*) through 4(*d*) of the accompanying drawings.

FIG. 3(*a*) shows in cross section the conventional waveguide-transmission line converter disclosed in Japanese laid-open patent publication No. 2002-359508, the view showing an assembling error occurring on the waveguide-transmission line converter. As shown in FIG. 3(*a*), the matching element J6 and the ground metal layer J4 are spaced a predetermined distance from each other. If the dielectric substrate J1 is assembled in position in exact alignment with the waveguide J3, as shown in FIG. 1(*b*), then since the edges of the matching element J6 are spaced a shortest distance from the edges of the ground metal layer 4, no problem arises in the propagation of electromagnetic energy. However, if the dielectric substrate J1 is assembled out of alignment with the waveguide J3, as shown in FIG. 3(*a*), an edge J6*a* of the matching element J6 is spaced a shortest distance from an upper inner corner J3*a* of a side wall of the waveguide J3, not from an edge J4*a* of the ground metal layer J4. Therefore, an electric field concentration occurs in an encircled area E in FIG. 3(*a*), i.e., an area including the edge J6*a* and the upper inner corner J3*a*, tending to change the electromagnetic energy passing and reflecting characteristics of the waveguide-transmission line converter.

FIG. 3(*b*) shows in cross section the conventional waveguide-transmission line converter disclosed in Japanese laid-open patent publication No. H10-126114, the view showing an assembling error occurring on the waveguide-transmission line converter. As shown in FIG. 3(*b*), the stripline J12 and the short-circuit waveguide block J15 are spaced a predetermined distance from each other. If the dielectric substrate J11 is assembled in position in exact alignment with the waveguide J13, as shown in FIG. 2(*b*), then since an edge of the stripline J11 is spaced a shortest distance from the inner surface of a side wall of the short-circuit waveguide block J15, no problem arises in the propagation of electromagnetic energy. However, if the dielectric substrate J11 is assembled out of alignment with the waveguide J13, as shown in FIG. 3(*b*), the edge J12*a* of the stripline J12 is spaced a shortest distance from an upper inner corner J13*a* of a side wall of the waveguide J13, not from an inner surface portion J15*a* of the side wall of the short-circuit waveguide block J15. Therefore, an electric field concentration occurs in an encircled area F in FIG. 3(*b*), i.e., an area including the edge J12*a* and the upper inner corner J13*a*, tending to change the electromagnetic energy passing and reflecting characteristics of the waveguide-transmission line converter. FIGS. 4(*a*) through 4(*d*) show the relationship based on experimental numerical calculations between assembling errors of the waveguide-transmission line converter disclosed in Japanese laid-open patent publication No. 2002-359508 and variations of the electromagnetic energy passing and reflecting characteristics thereof. In each of FIGS. 4(*a*) through 4(*d*), a curve plotted by interconnecting symbols Δ represents the magnitude, represented by an amplitude, of a reflected electromagnetic energy when an electromagnetic energy is transmitted from the stripline J2 to the waveguide J3, a curve plotted by interconnecting symbols ○ represents the magnitude, represented by an amplitude, of a reflected electromagnetic energy when an electromagnetic energy is transmitted from the waveguide J3 to the stripline J2, and a curve plotted by interconnecting symbols □ represents the magnitude, represented by an amplitude of a passed electromagnetic energy when an electromagnetic energy is transmitted from the waveguide J3 to the stripline J2. FIG. 4(*a*) shows the relationship plotted when the dielectric substrate J1 was not displaced out of alignment with the waveguide J3, i.e., the dielectric substrate J1 was displaced out of alignment with the waveguide J3 by no displacement of aO. FIG. 4(*b*) shows the relationship plotted when the dielectric substrate J1 was displaced out of alignment with the waveguide J3 by a displacement of a1 which was greater than no displacement of aO. FIG. 4(*c*) shows the relationship plotted when the dielectric substrate J1 was displaced out of alignment with the waveguide J3 by a displacement of a2 which was greater than the displacement of a1. FIG. 4(*d*) shows the relationship plotted when the dielectric substrate J1 was displaced out of alignment with the waveguide J3 by a displacement of a3 which was greater than the displacement of a2.

It can be seen from FIGS. 4(*a*) through 4(*d*) that if there is no displacement between the dielectric substrate J1 and the waveguide J3, any electromagnetic energy reflection is small in the frequency range in which the waveguide-transmission line converter is used, but the magnitude of the electromagnetic energy reflection varies greatly outside of that frequency range. It can also be understood that if the dielectric substrate J1 is displaced out of alignment with and the waveguide J3, then small electromagnetic energy reflection occurs at different frequencies depending on the displacement. For example, if the dielectric substrate J1 is displaced out of alignment with the waveguide J3 by the displacement of a1, then the magnitude of any electromagnetic energy reflection in the millimeter wave range from 76 to 77 GHz is widely different from the magnitude of any electromagnetic energy reflection in the millimeter wave range that occurs if the dielectric substrate J1 is not displaced out of alignment with the waveguide J3 (see FIGS. 4(*a*) and 4(*b*)).

SUMMARY OF THE INVENTION

It is an object of the present invention to provide a waveguide-transmission line converter for converting electromagnetic energy to pass electromagnetic energy at a high ratio with low energy reflection even if the waveguide-transmission line converter suffers an assembling error.

To achieve the above object, there is provided in accordance with the present invention a waveguide-transmission line converter comprising a waveguide having a hollow shape with a hollow space defined therein, a dielectric substrate disposed on an open end of the waveguide, a strip line disposed on a surface of the dielectric substrate remote from the waveguide and extending from a substrate edge located at an outer side of the waveguide toward an interior region on the surface of the dielectric substrate a ground metal layer disposed on a surface of the dielectric substrate remote from the surface thereof on which the stripline is disposed, the ground metal layer extending along an outer edge of the dielectric substrate, and a matching element disposed on the surface of the dielectric substrate on which the ground metal layer is disposed, the matching element being spaced inwardly from the ground metal layer away from the outer edge of the dielectric substrate, the dielectric substrate being mounted on the open end of the waveguide with the ground metal layer interposed therebetween, whereby the waveguide-transmission line converter can convert electromagnetic energy transmitted by the waveguide and electromagnetic energy transmitted by the stripline into each other, wherein the waveguide has a beveled inner corner of a side wall thereof at the open end of the waveguide, and the hollow space is greater in size at the beveled inner corner than another portion of the side wall of the waveguide.

The above waveguide-transmission line converter is referred to as a patch-resonator waveguide-transmission line converter. Even if the dielectric substrate is assembled out of alignment with the waveguide due to an assembling error, an edge of the ground metal layer on the dielectric substrate is exposed from the beveled inner corner at the open end of the waveguide. The beveled inner corner keeps the waveguide spaced widely from an edge of the matching element on the dielectric substrate, preventing an electric field concentration from occurring between the waveguide and the matching element. The patch-resonator waveguide-transmission line converter has electromagnetic energy passing and reflecting characteristics prevented from varying.

In the patch-resonator waveguide-transmission line converter, the beveled inner corner of the side wall of the waveguide may be positioned near the side of the waveguide on which the stripline is disposed at the open end of the waveguide, and the waveguide may have another beveled inner corner of a side wall thereof which is positioned near another side of the waveguide which confronts the side of the waveguide at the open end of the waveguide. The beveled inner corners thus positioned near the respective sides of the waveguide are more effective to prevent an electric field concentration from occurring between the waveguide and the matching element.

In the patch-resonator waveguide-transmission line converter, a circle having a radius equal to the distance from an edge of the matching element to an edge of the ground metal layer may be drawn about the edge of the matching element, and the beveled inner corner of the waveguide may have a surface spaced from the edge of the matching element by a distance greater than the radius of the circle. With the surface of the beveled inner corner being spaced from the edge of the matching element by a distance greater than the radius of the circle, the distance between the edge of the matching element and the surface of the beveled inner corner is larger than the distance between the matching element and the short-circuit metal layer. Accordingly, the beveled inner corner is more effective to prevent an electric field concentration from occurring between the waveguide and the matching element. According to the present invention, there is also provided a waveguide-transmission line converter comprising a waveguide having a hollow shape with a hollow space defined therein, a short-circuit waveguide block disposed on an open end of the waveguide, a dielectric substrate fixedly disposed between the open end of the waveguide and the short-circuit waveguide block and sandwiched between the waveguide and the short-circuit waveguide block, a stripline disposed on a surface of the dielectric substrate remote from the waveguide and extending a substrate edge located at from the outer side of the waveguide toward the interior region on the surface of the dielectric substrate, and a ground metal layer disposed on a surface of the dielectric substrate remote from the surface thereof on which the stripline is disposed, the ground metal layer extending along an outer edge of the dielectric substrate, the dielectric substrate being mounted on the open end of the waveguide with the ground metal layer interposed therebetween, whereby the waveguide-transmission line converter can convert electromagnetic energy transmitted by the waveguide and electromagnetic energy transmitted by the stripline into each other, wherein the waveguide has a beveled inner corner of a side wall thereof at the open end of the waveguide, and the hollow space is greater in size at the beveled inner corner than another portion of the side wall of the waveguide.

The above waveguide-transmission line converter is referred to as a back-short waveguide-transmission line converter. In the back-short waveguide-transmission line converter, the beveled inner corner keeps the waveguide spaced widely from an edge of the stripline on the dielectric substrate, thereby preventing an electric field concentration from occurring between the waveguide and the stripline. The back-short waveguide-transmission line converter has electromagnetic energy passing and reflecting characteristics prevented from varying.

In the back-short waveguide-transmission line converter, the beveled inner corner of the side wall of the waveguide may be positioned near a side of the waveguide which confronts the side of the waveguide on which the stripline is disposed at the open end of the waveguide. The beveled inner corner thus positioned near the side of the waveguide is more effective to prevent an electric field concentration from occurring between the waveguide and the matching element.

In the back-short waveguide-transmission line converter, a circle having a radius equal to the distance from an edge of the stripline to a closest surface portion of the short-circuit waveguide block may be drawn about the edge of the stripline, and the beveled inner corner of the waveguide may have a surface spaced from the edge of the stripline by a distance greater than the radius of the circle. With the surface of the beveled inner corner being spaced from the edge of the stripline by a distance greater than the radius of the circle, the distance between the edge of the stripline and the surface of the beveled inner corner is larger than the distance between the stripline and the short-circuit metal layer. Accordingly, the beveled inner corner is more effective to prevent an electric field concentration from occurring between the waveguide and the stripline.

In the patch-resonator or back-short waveguide-transmission line converter, the beveled inner corner may comprise a tapered surface, a right-angularly stepped surface, an arcuately concave surface, or an irregularly concave surface.

According to the present invention, there is further provided a waveguide-transmission line converter for converting electromagnetic energy between a waveguide and a transmission line, comprising a waveguide having an open end, a dielectric substrate disposed on the open end of the waveguide and having a first surface facing away from the waveguide and a second surface facing toward the waveguide, a stripline mounted on the first surface of the dielectric substrate and extending from a side of the waveguide toward an opposite side of the waveguide, a ground metal layer disposed on the second surface of the dielectric substrate and extending along an outer edge of the dielectric substrate, the ground metal layer being interposed between the dielectric substrate and the waveguide, and a matching element disposed on the second surface of the dielectric substrate and spaced inwardly from the ground metal layer, wherein the waveguide has a side wall having a tapered inner surface at the open end thereof. The tapered inner surface may be spaced from a closest edge of the matching element by a distance greater than the distance between the closest edge of the matching element and an edge of the ground metal layer which is closest to the matching element.

According to the present invention, there is further provided a waveguide-transmission line converter for converting electromagnetic energy between a waveguide and a transmission line, comprising a waveguide having an open end, a short-circuit waveguide block disposed on an open end of the waveguide, a dielectric substrate fixedly disposed between the open end of the waveguide and the short-circuit waveguide block, the dielectric substrate having a first surface facing away from the waveguide and a second surface facing toward the waveguide, a stripline disposed on the first surface of the dielectric substrate and extending from a side of the waveguide inwardly into the open end of the waveguide, and a ground metal layer disposed on the second surface of the dielectric substrate, the ground metal layer extending along an outer edge of the dielectric substrate, the dielectric substrate being mounted on the open end of the waveguide with the ground metal layer interposed therebetween, wherein the waveguide has a side wall having a tapered inner surface at the open end thereof. The tapered inner surface may be spaced from a closest edge of the stripline by a distance greater than the distance between the closest edge of the stripline and a surface portion of the short-circuit waveguide block which is closest to the stripline.

The above and other objects, features, and advantages of the present invention will become apparent from the following description when taken in conjunction with the accompanying drawings which illustrate preferred embodiments of the present invention by way of example.

BRIEF DESCRIPTION OF THE DRAWINGS

FIG. 1(*b*)is a cross-sectional view of the conventional patch-resonator waveguide-transmission line converter shown in FIG. 1(*a*);

FIG. 1(*c*) is a plan view of the conventional waveguide-transmission line converter shown in FIG. 1(*a*);

FIG. 1(*d*) is a bottom view of a dielectric substrate of the conventional patch-resonator waveguide-transmission line converter shown in FIG. 1(*a*);

FIG. 2(*b*)is a cross-sectional view of the conventional back-short waveguide-transmission line converter shown in FIG. 2(*a*);

FIG. 2(*c*) is a plan view of a dielectric substrate of the conventional back-short waveguide-transmission line converter shown in FIG. 2(*a*);

FIG. 2(*d*) is a bottom view of the dielectric substrate of the conventional back-short waveguide-transmission line converter shown in FIG. 2(*a*);

FIG. 3(*b*)is a cross-sectional view showing an assembling error occurring on the conventional back-short waveguide-transmission line converter shown in FIGS. 2(*a*) through 2(*d*);

DESCRIPTION OF THE PREFERRED EMBODIMENTS

Figure 1B:
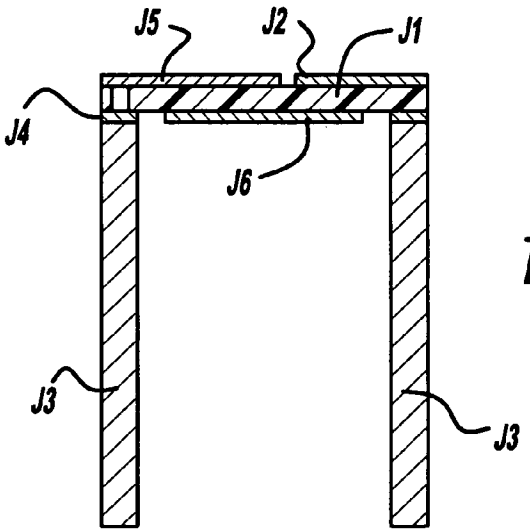
FIG - 1b Prior Art
FIG. 1(*a*) is a perspective view of a conventional patch-resonator waveguide-transmission line converter.
Figure 1D:
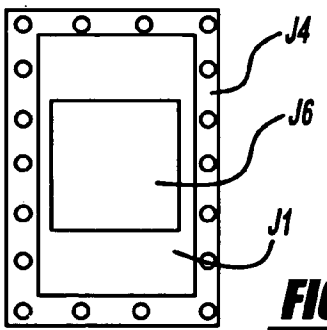
FIG - 1d Prior Art
Figure 1C:
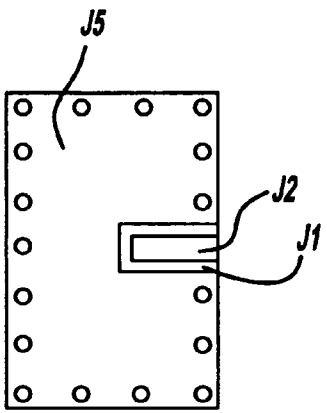
FIG - 1c Prior Art
Figure 1A:
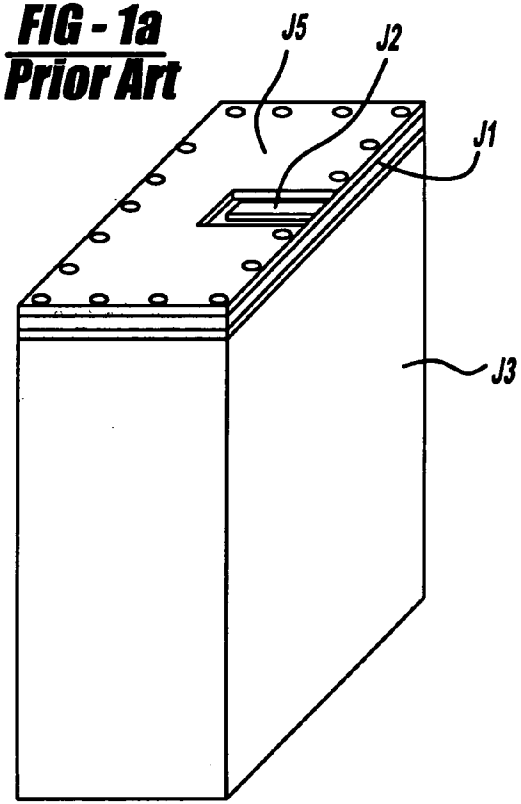
FIG - 1a Prior Art

Like or corresponding parts are denoted by like or corresponding reference characters throughout views and may not be described in detail for all drawing figures.

1st Embodiment

Figure 5:
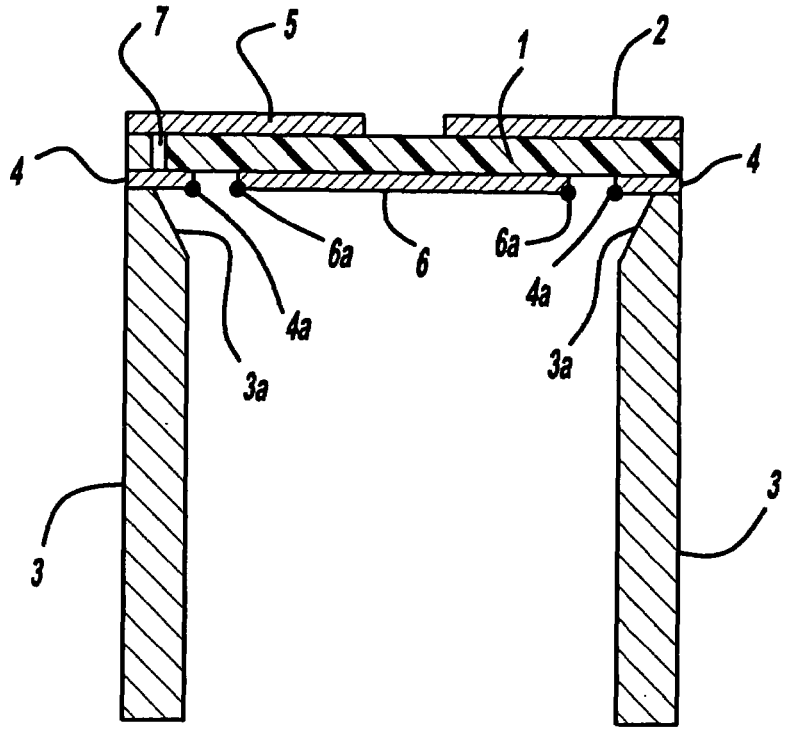
FIG. 5 is a cross-sectional view of a patch-resonator waveguide-transmission line converter according to a first embodiment of the present invention.

FIG. 5 shows in cross section a patch-resonator waveguide-transmission line converter according to a first embodiment of the present invention. The patch-resonator waveguide-transmission line converter according to the first embodiment has structural details similar to those of the conventional patch-resonator waveguide-transmission line converter shown in FIGS. 1(*a*), 1(*c*), and 1(*d*). For those similar structural details, therefore, reference should be made to FIGS. 1(*a*), 1(*c*), and 1(*d*).

As shown in FIG. 5, the patch-resonator waveguide-transmission line converter according to the first embodiment has a dielectric substrate 1, a strip-line 2 mounted on the dielectric substrate 1, a waveguide 3 connected to the dielectric substrate 1 with a ground metal layer 4 interposed therebetween, a short-circuit plate 5 mounted on the dielectric substrate 1, and a matching element 6 mounted on the dielectric substrate 1 remotely from the stripline 2 and the short-circuit plate 5.

The dielectric substrate 1 is of an elongate rectangular shape, and the stripline 2 is disposed on one surface (face side) of the dielectric substrate 1. The stripline 2 extends perpendicularly to one longitudinal side of the dielectric substrate 1, i.e., extends inwardly from the outer side of the waveguide 3 which is of a hollow shape toward the opposite outer side of the waveguide 3.

The waveguide 3 of a hollow shape has a hollow space defined therein. The waveguide 3 has an elongate rectangular cross-sectional shape across its axis which extends vertically in FIG. 5, the elongate rectangular cross-sectional shape being substantially the same as the elongate rectangular shape of the dielectric substrate 1. The dielectric substrate 1 is fixed to the open end of the waveguide 3 with the ground metal layer 4 interposed therebetween.

The waveguide 3 has opposite side walls which are basically of a substantially constant thickness. However, the side walls of the waveguide 3 have thinner portions near the open end to which the dielectric substrate 1 is fixed. Therefore, the hollow space in the waveguide 3 is greater in size at those thinner portions of the side walls thereof than at the other portions of the side walls. Specifically, inner corners of the side walls of the waveguide 3 that are positioned near one longitudinal side of the waveguide 3 on which the strip-line 2 is disposed and a confronting opposite longitudinal side of the waveguide 3 at the open end of the waveguide 3 are beveled such that the inner corners of the side walls are tapered toward the ground metal layer 4, providing tapered inner surfaces 3*a*.

The ground metal layer 4 which is in the form of a centrally open rectangular frame has a width that is substantially the same as the thickness of each of the side walls of the waveguide 3 except for the tapered inner corners thereof. The ground metal layer 4 is disposed on the surface (reverse side) of the dielectric substrate 1 remote from the surface thereof on which the stripline 2 is mounted. The ground metal layer 4 extends along the outer edges of the dielectric substrate 1 which is of an elongate rectangular shape. The dielectric substrate 1 is securely fixed to the open end of the waveguide 3 with the ground metal layer 4 interposed therebetween.

The short-circuit plate 5 is of an outer profile which is substantially the same as the elongate rectangular shape of the dielectric substrate 1. The short-circuit plate 5 is fixed to the dielectric substrate 1 as by welding. The short-circuit plate 5 has a recess defined centrally therein which is open at a longitudinal side edge thereof. With the short-circuit plate 5 fixedly mounted on the dielectric substrate 1, the stripline 2 is disposed in and exposed from the recess. The short-circuit plate 5 also has a plurality of through holes 7 defined therein along the outer edges thereof. The short-circuit plate 5 is electrically connected to the ground metal layer 4 through the through holes 7.

The matching element 6 is mounted centrally on the surface of the dielectric substrate 1 remote from the stripline 2 and the short-circuit plate 5 and is positioned centrally in the hollow space in the waveguide 3. The matching element 6 comprises a substantially square metal layer. The matching element 6 is spaced a predetermined distance from the stripline 2, and electromagnetically coupled to the stripline 2 across the dielectric substrate 1.

Figure 6:
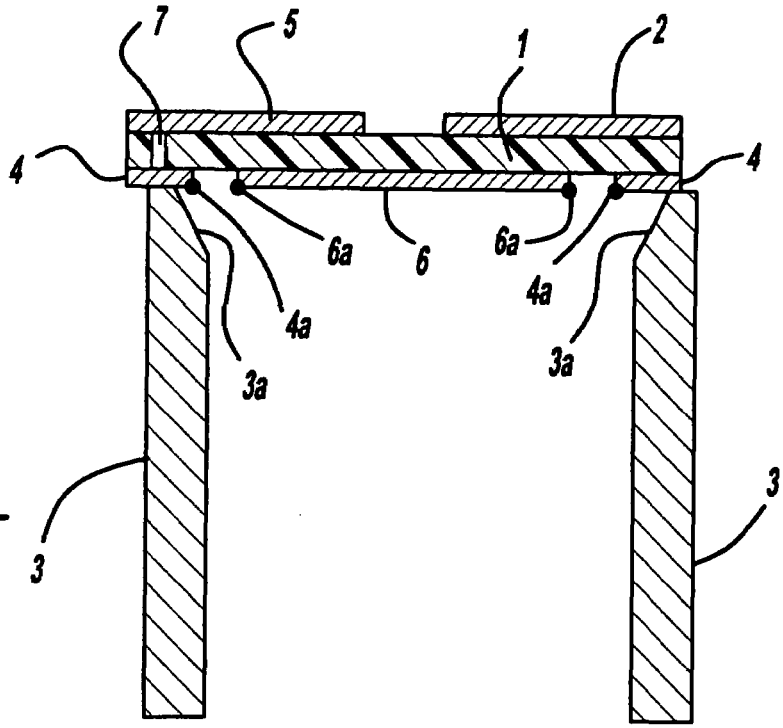
FIG. 6 is a cross-sectional view showing an assembling error that occurs on the patch-resonator waveguide-transmission line converter shown in FIG. 5 when a dielectric substrate is assembled out of alignment with a waveguide.
Figure 7A:
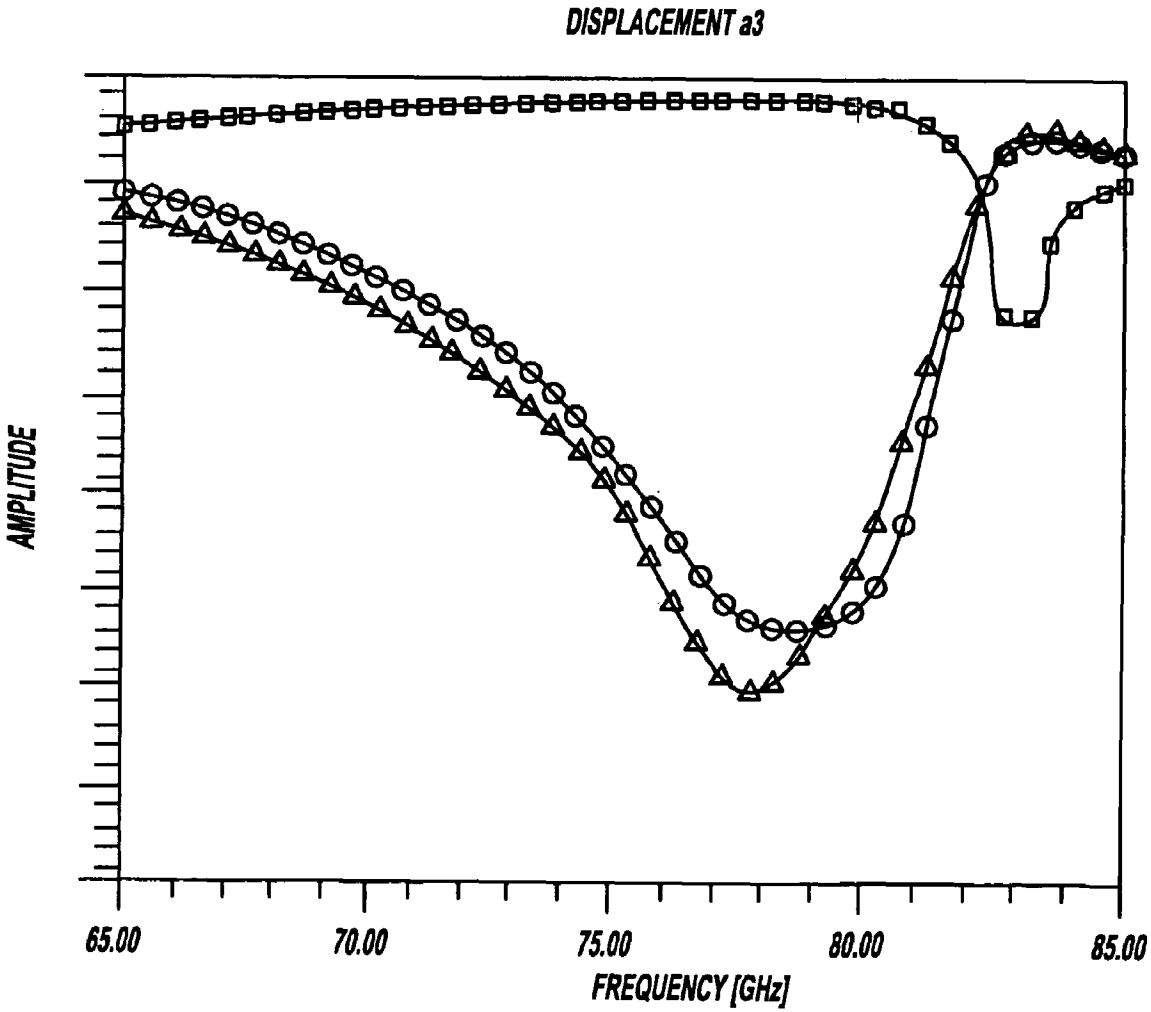
FIGS. 7(*a*) through 7(*d*) are diagrams showing the relationship between frequency and amplitude based on experimental numerical calculations between assembling errors of the patch-resonator waveguide-transmission line converter shown in FIG. 5 and variations of the electromagnetic energy passing and reflecting characteristics thereof.
Figure 7B:
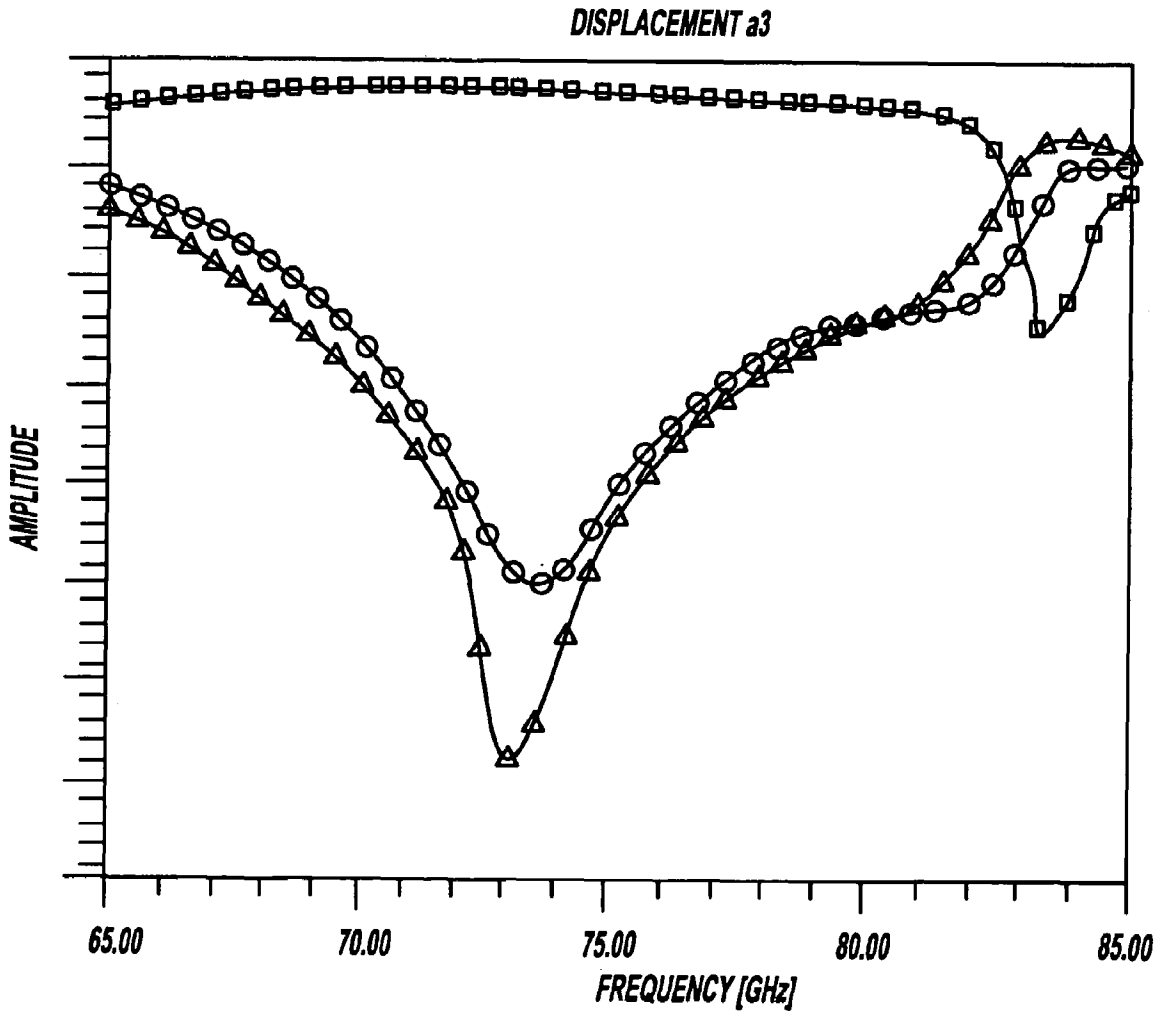
Figure 7C:
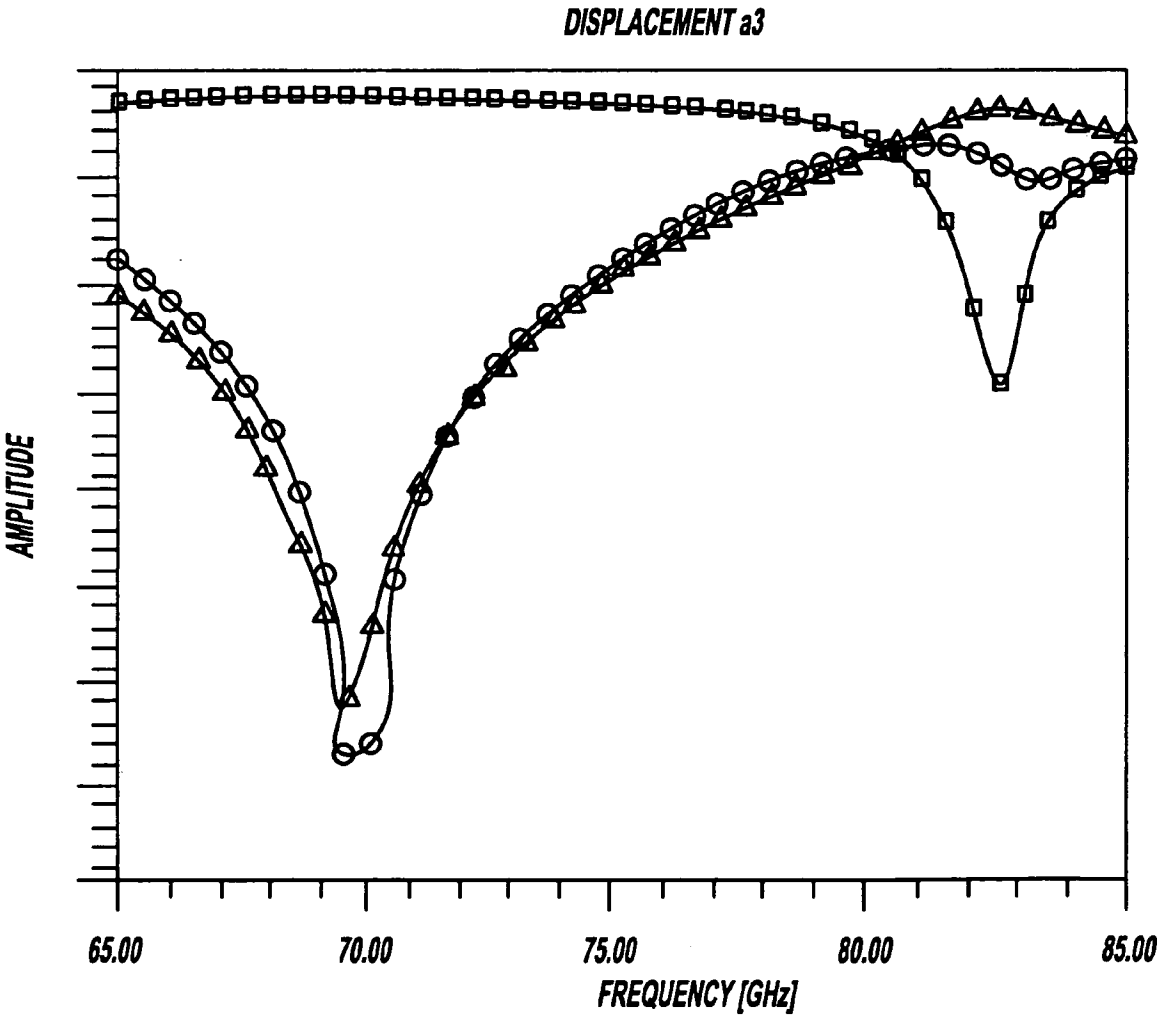
Figure 7D:
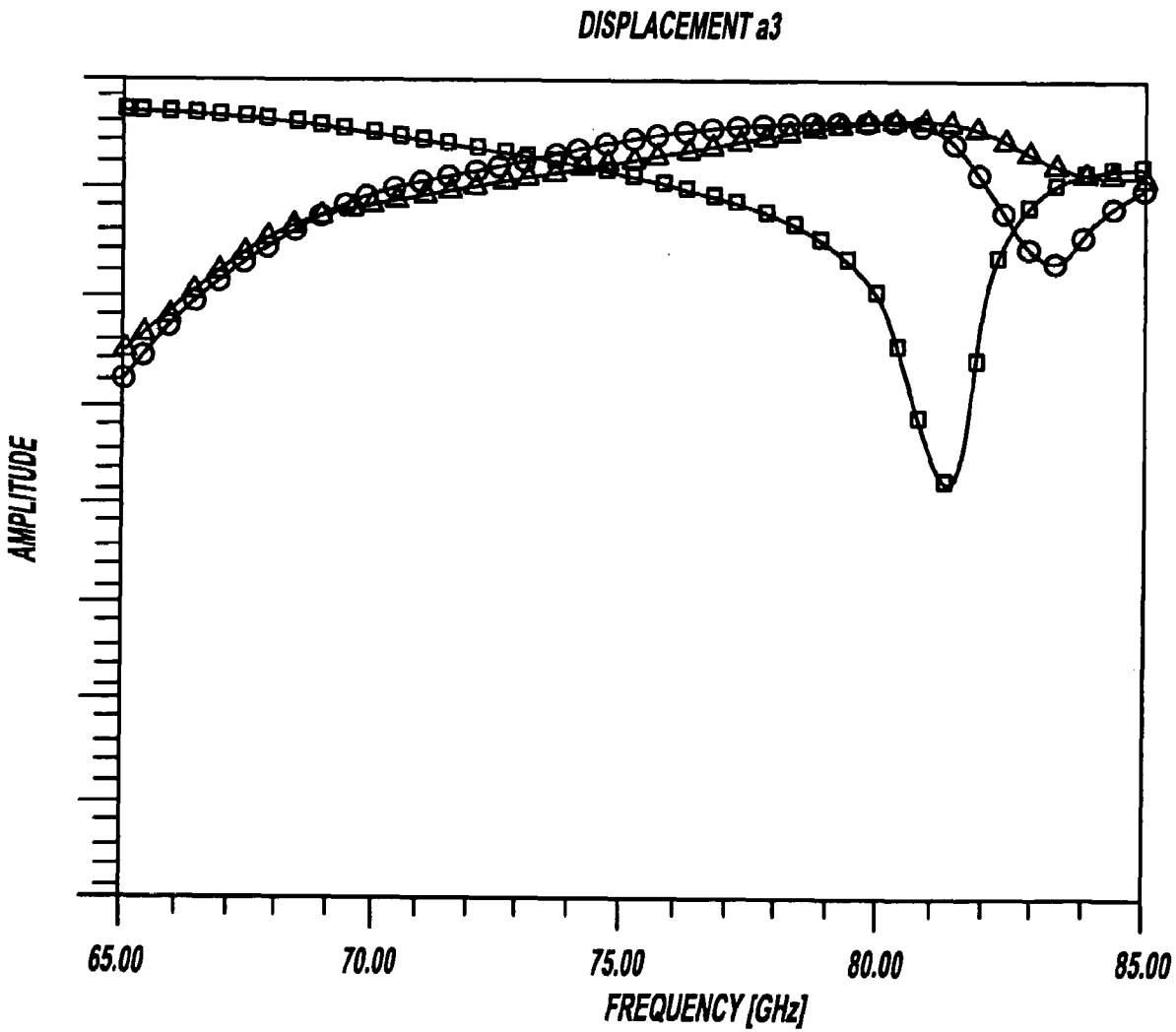

FIG. 6 shows in cross section an assembling error that occurs on the patch-resonator waveguide-transmission line converter shown in FIG. 5 when the dielectric substrate 1 is assembled out of alignment with the waveguide 3. As shown in FIG. 6, when the dielectric substrate 1 and the waveguide 3 are assembled together, the dielectric substrate 1 is possibly displaced out of alignment with the waveguide 3 due to an assembling error.

Even if the dielectric substrate 1 is assembled out of alignment with the waveguide 3, however, since the inner corners of the side walls of the waveguide 3 at the open end thereof are beveled or tapered, the ground metal layer 4 has inner edges 4*a* exposed from the inner corners of the side walls of the waveguide 3 at the open end thereof. The matching element 6 has opposite edges 6*a* spaced a shortest distance from the exposed inner edges 4*a* of the ground metal layer 4, but not from the side walls of the waveguide 3. Consequently, no undue electric field concentration occurs between the matching element 6 and the waveguide 3, and hence the patch-resonator waveguide-transmission line converter has electromagnetic energy passing and reflecting characteristics prevented from varying.

FIGS. 7(*a*) through 7(*d*) show the relationship based on experimental numerical calculations between assembling errors of the patch-resonator waveguide-transmission line converter according to the first embodiment and variations of the electromagnetic energy passing and reflecting characteristics thereof. In each of FIGS. 7(*a*) through 7(*d*), a curve plotted by interconnecting symbols Δ represents the magnitudes, represented by an amplitude, of a reflected electromagnetic energy when an electromagnetic energy is transmitted from the stripline 2 to the waveguide 3, a curve plotted by interconnecting symbols ○ represents the magnitude, represented by an amplitude, of a reflected electromagnetic energy when an electromagnetic energy is transmitted from the waveguide 3 to the stripline 2, and a curve plotted by interconnecting symbols □ represents the magnitude, represented by an amplitude, of a passed electromagnetic energy when an electromagnetic energy is transmitted from the waveguide 3 to the stripline 2. FIG. 7(*a*) shows the relationship plotted when the dielectric substrate 1 was not displaced out of alignment with the waveguide 3, i.e., the dielectric substrate 1 was displaced out of alignment with the waveguide 3 by no displacement of aO. FIG. 7(*b*) shows the relationship plotted when the dielectric substrate 1 was displaced out of alignment with the waveguide 3 by a displacement of a1 which was greater than no displacement of aO. FIG. 7(*c*) shows the relationship plotted when the dielectric substrate 1 was displaced out of alignment with the waveguide 3 by a displacement of a2 which was greater than the displacement of a1. FIG. 7(*d*) shows the relationship plotted when the dielectric substrate 1 was displaced out of alignment with the waveguide 3 by a displacement of a3 which was greater than the displacement of a2.

A comparison between FIGS. 7(*a*) through 7(*d*) and FIGS. 4(*a*) through 4(*d*) indicates that changes in the electromagnetic energy passing and reflecting characteristics, i.e., positional changes of lowest-reflection peaks, of the patch-resonator waveguide-transmission line converter according to the first embodiment are smaller than those of the conventional patch-resonator waveguide-transmission line converter for the same displacements. Since the electromagnetic energy passing and reflecting characteristics are substantially determined based on the lowest-reflection peaks, electromagnetic energy reflections in the target frequency range from 76 to 77 GHz are reduced as positional changes of lowest-reflection peaks are reduced.

Figure 8:
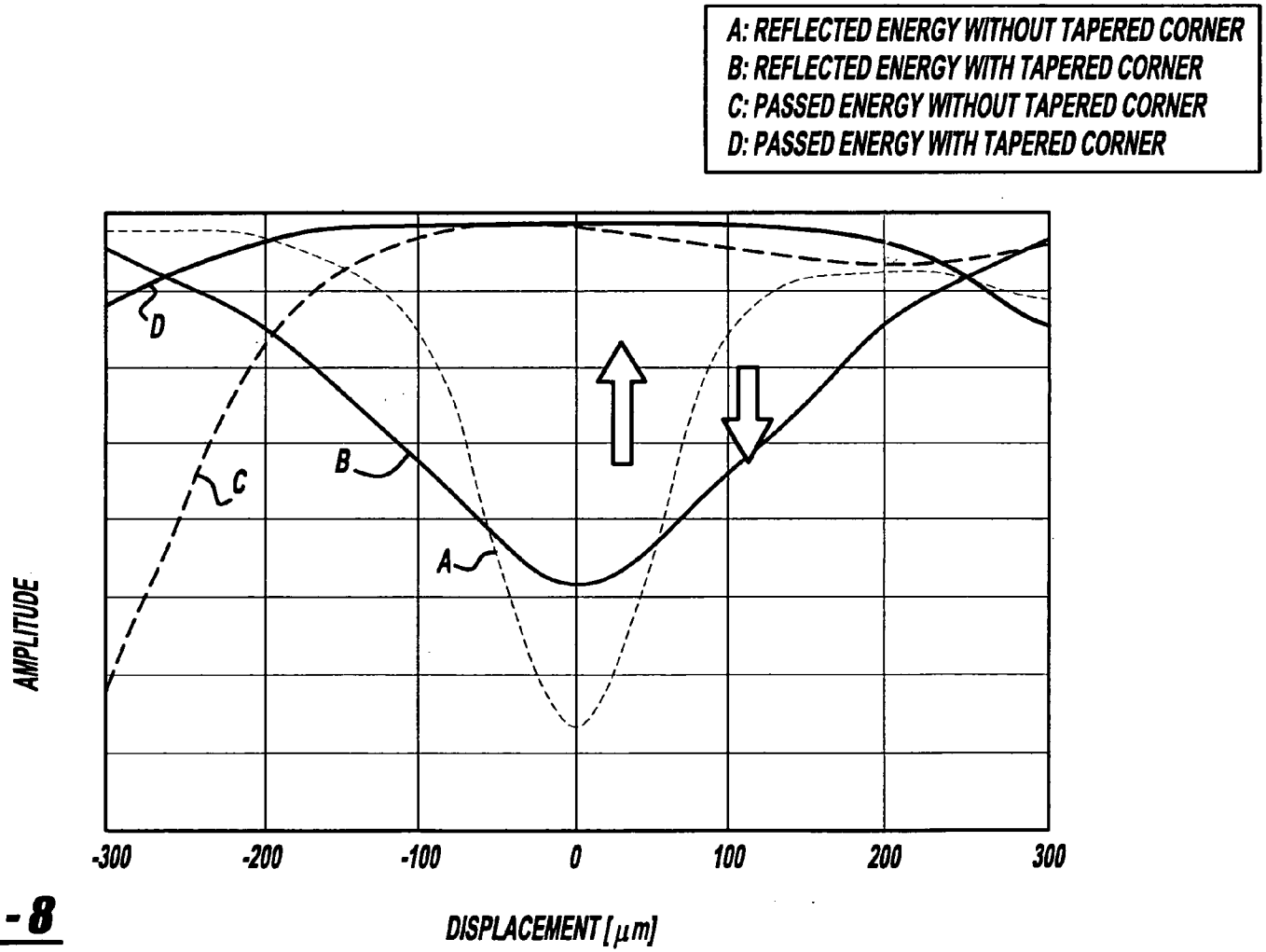
FIG. 8 is a diagram showing the relationship between displacements between the dielectric substrate and the waveguide and the magnitudes of passed and reflected electromagnetic energies when the inner corners of side walls of the waveguide are tapered and not tapered.

FIG. 8 shows the relationship between displacements between the dielectric substrate 1 and the waveguide 3 and the magnitudes which are represented by amplitudes of passed and reflected electromagnetic energies when the inner corners of the side walls of the waveguide 3 are tapered and not tapered. In FIG. 8, a dotted-line curve A represents the magnitude of a reflected electromagnetic energy when the inner corners of the side walls of the waveguide 3 are not tapered, and a solid-line curve B represents the magnitude of a reflected electromagnetic energy when the inner corners of the side walls of the waveguide 3 are tapered. A dotted-line curve C represents the magnitude of a passed electromagnetic energy when the inner corners of the side walls of the waveguide 3 are not tapered, and a solid-line curve D represents the magnitude of a passed electromagnetic energy when the inner corners of the side walls of the waveguide 3 are tapered. A study of FIG. 8 clearly reveals that the magnitude of the passed electromagnetic energy is greater and the magnitude of the reflected electromagnetic energy is smaller when the inner corners of the side walls of the waveguide 3 are tapered than when the inner corners of the side walls of the waveguide 3 are not tapered.

As described above, the patch-resonator waveguide-transmission line converter according to the first embodiment is capable of passing electromagnetic energy at a high ratio with low energy reflection even if the waveguide-transmission line converter suffers an assembling error.

Figure 9:
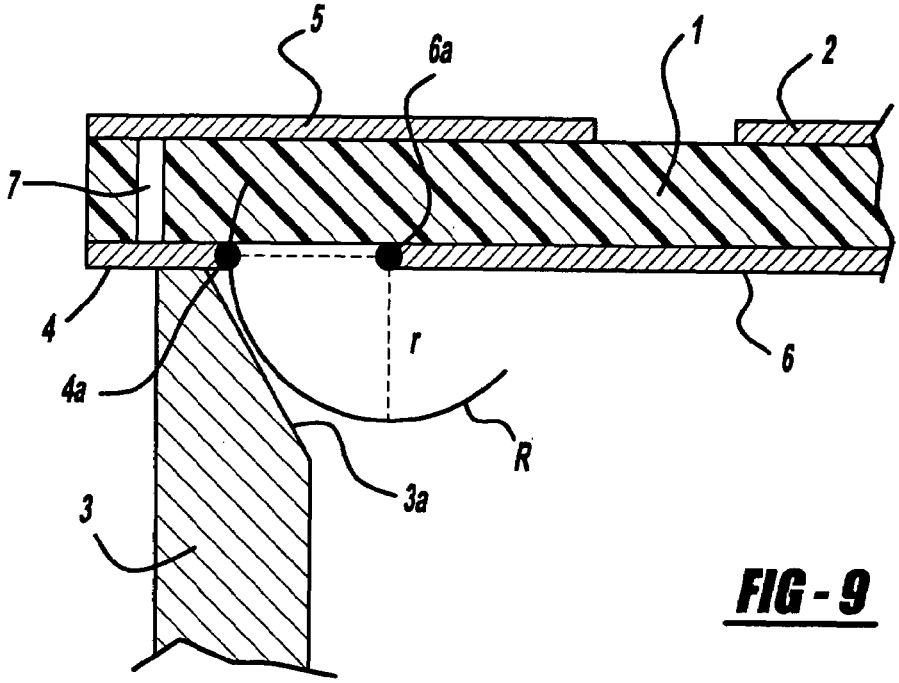
FIG. 9 is an enlarged fragmentary cross-sectional view showing the positional relationship between a tapered inner surface of one of the side edges of the waveguide at the opening end thereof and an edge of a matching element of the patch-resonator waveguide-transmission line converter shown in FIG. 5.

According to the first embodiment, since sharp corners are eliminated from the side walls of the waveguide 3 at the opening end thereof by the tapered inner surfaces 3*a* of the side walls of the waveguide 3, it is enough for the inner corners of side walls of the waveguide 3 at the opening end thereof to be beveled as shown in FIG. 5. However, for better electromagnetic energy passing and reflecting characteristics, the inner corners of side walls of the waveguide 3 at the opening end thereof should preferably be beveled as follows:

FIG. 9 shows the positional relationship between the tapered inner surface 3*a* of one of the side walls of the waveguide 3 at the opening end thereof and an edge of the matching element 6 of the patch-resonator waveguide-transmission line converter shown in FIG. 5. As shown in FIG. 9, a circle R having a radius r from the edge 6*a* of the matching element 6 to the edge 4*a* of the ground metal layer 4 is drawn about the edge 6*a* of the matching element 6, and the tapered inner surface 3*a* of the waveguide 3 is positioned outside of the circle R, i.e., is spaced from the center of the circle R by a distance greater than the radius r. In this manner, the minimum distance between the edge 6*a* of the matching element 6 and the tapered inner surface 3*a* of the waveguide 3 is greater than the distance between the edge 6*a* of the matching element 6 and the edge 4*a* of the ground metal layer 4. Each of the inner corners of the side walls of the waveguide 3 at the opening end thereof is beveled to satisfy the above positional relationship even when the edge 6*a* of the matching element 6 is closest to the tapered inner surface 3*a* of the waveguide 3 due to a maximum possible displacement or distance by which the dielectric substrate 1 is displaced out of the alignment with the waveguide 3 due to an assembling error. The patch-resonator waveguide-transmission line converter thus constructed is capable of passing electromagnetic energy at a high ratio with low energy reflection even if the waveguide-transmission line converter suffers an assembling error.

2nd Embodiment

Figures 2A, 2B, 2C, 2D:
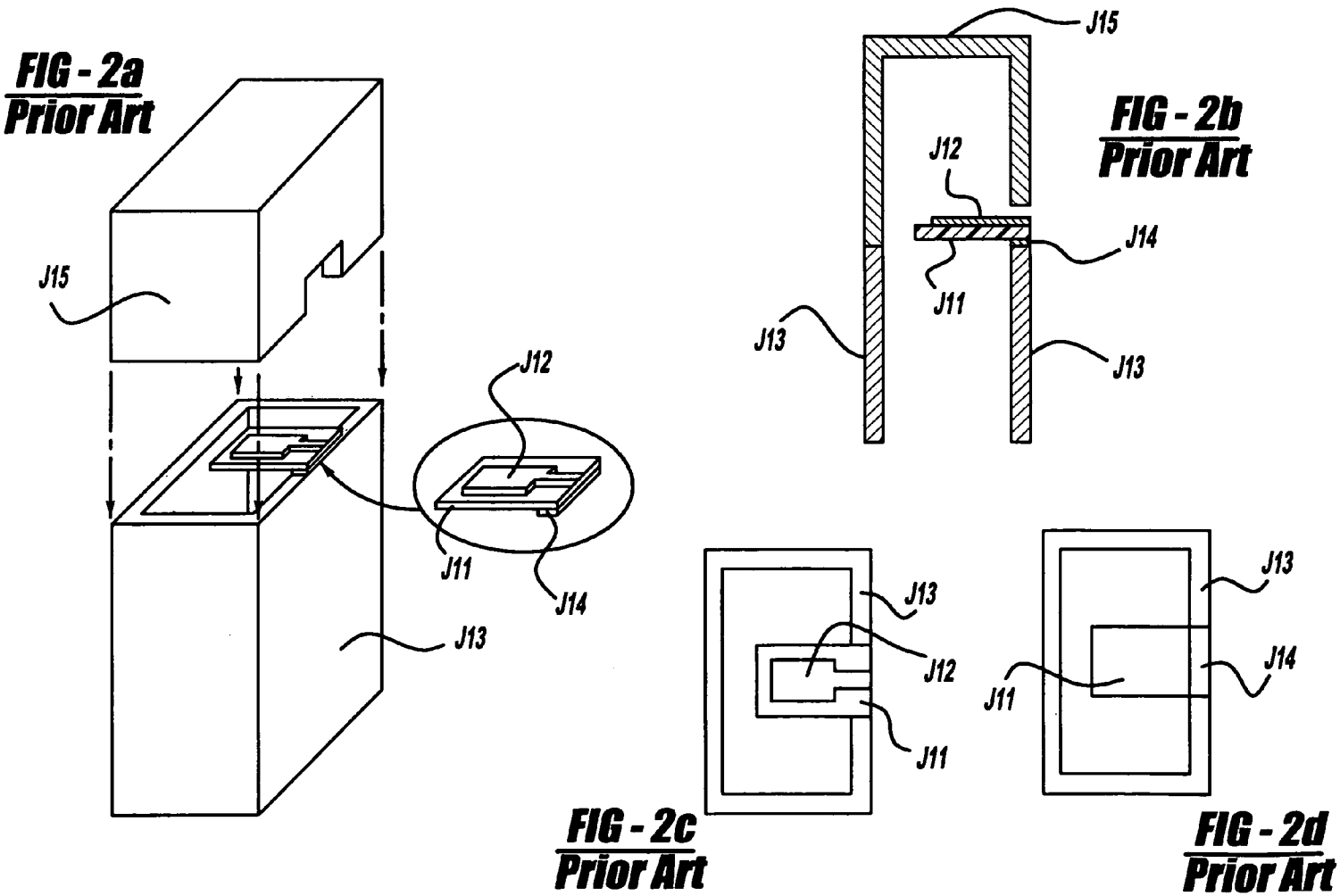
FIG - 2a Prior Art
FIG - 2b Prior Art
FIG - 2c Prior Art
FIG - 2d Prior Art
FIG. 2(*a*) is an exploded perspective view of a conventional back-short waveguide-transmission line converter.
Figure 3B:
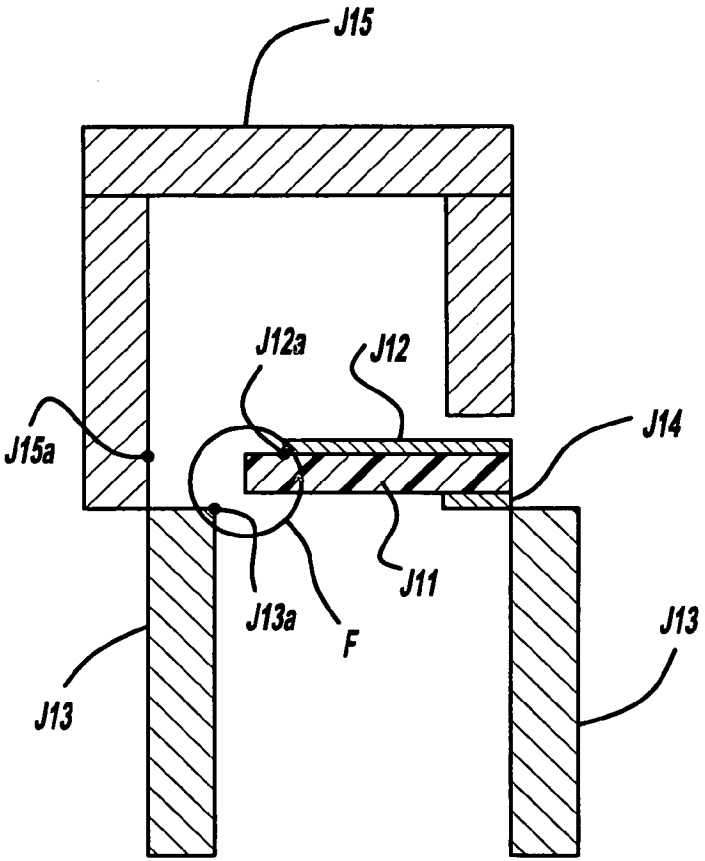
FIG - 3b Prior Art
FIG. 3(*a*) is a cross-sectional view showing an assembling error occurring on the conventional patch-resonator waveguide-transmission line converter shown in FIGS. 1(*a*) through 1(*d*)
Figure 3A:
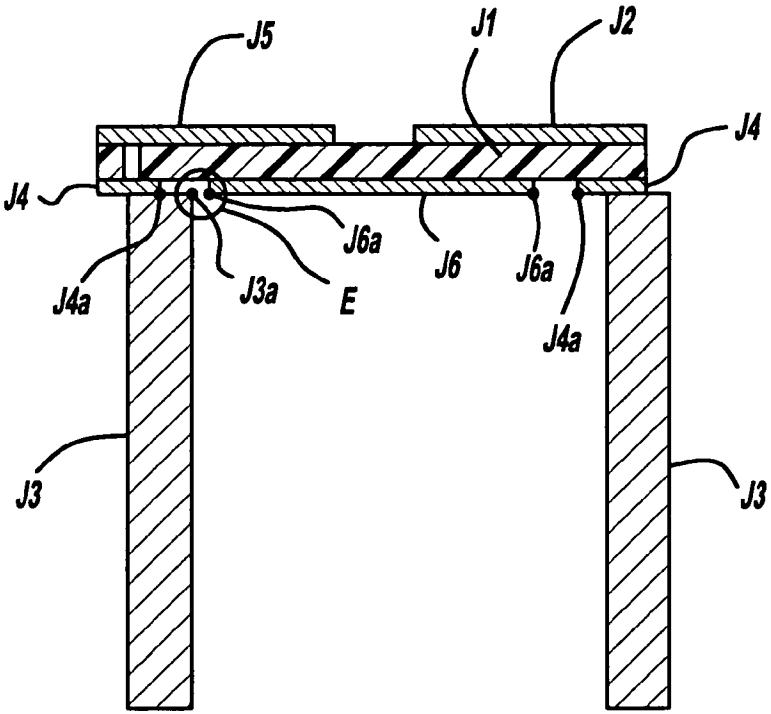
FIG - 3a Prior Art
Figure 4A:
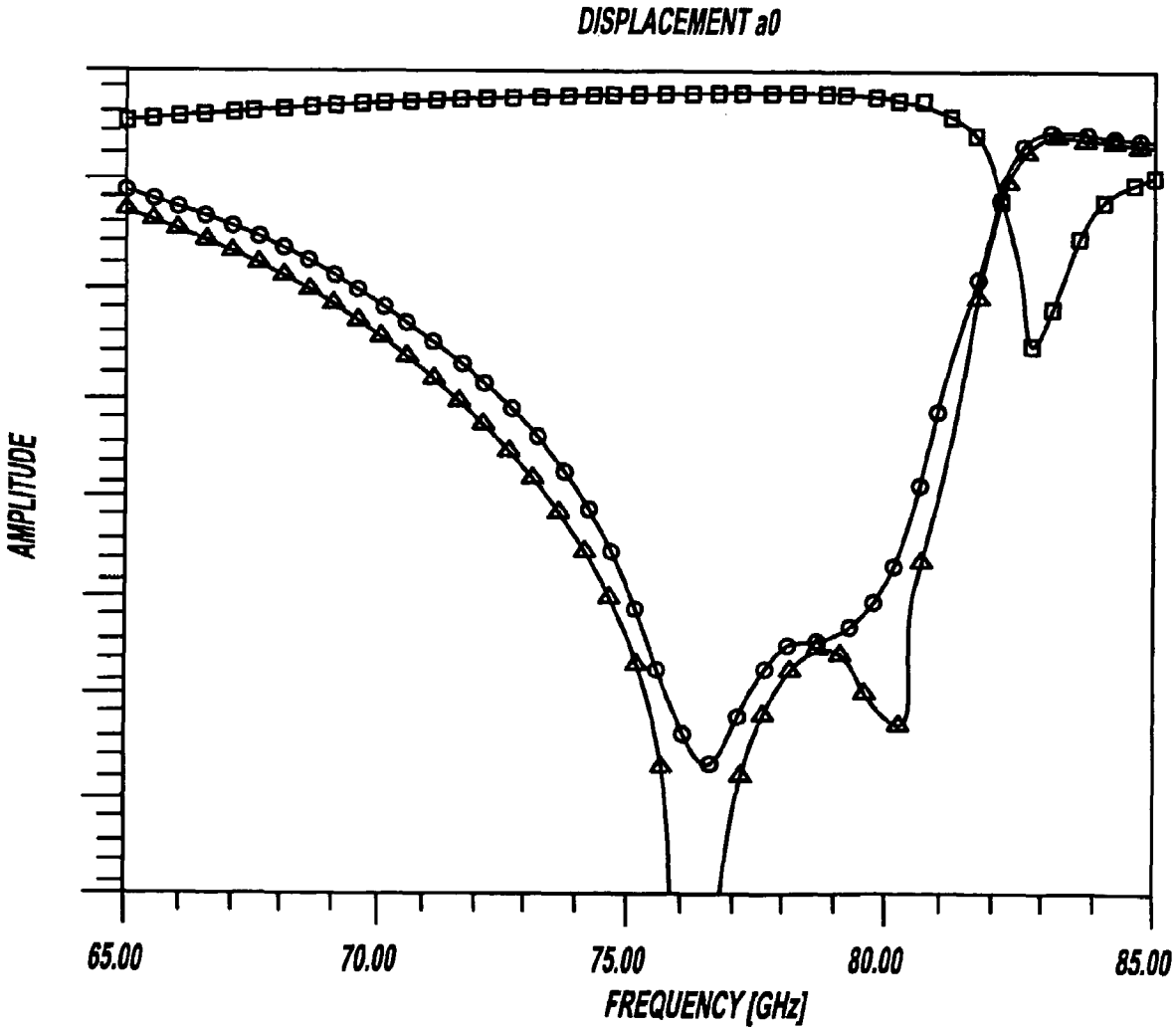
FIG - 4a Prior Art
FIGS. 4(*a*) through 4(*d*) are diagrams showing the relationship between frequency and amplitude based on experimental numerical calculations between assembling errors of the conventional patch-resonator waveguide-transmission line converter shown in FIGS. 1(*a*) through 1(*d*) and variations of the electromagnetic energy passing and reflecting characteristics thereof.
Figure 4B:
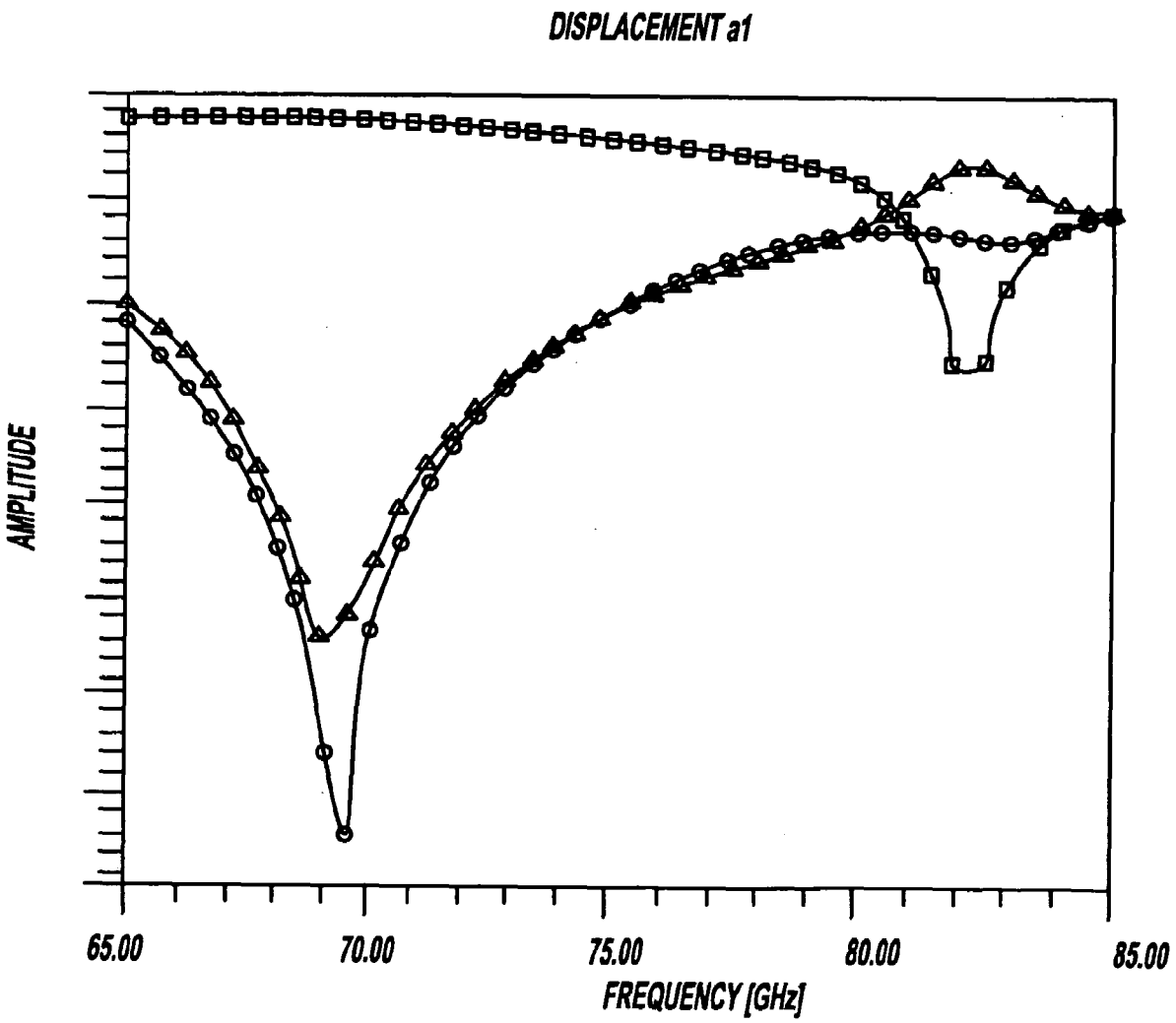
FIG - 4b Prior Art
Figure 4C:
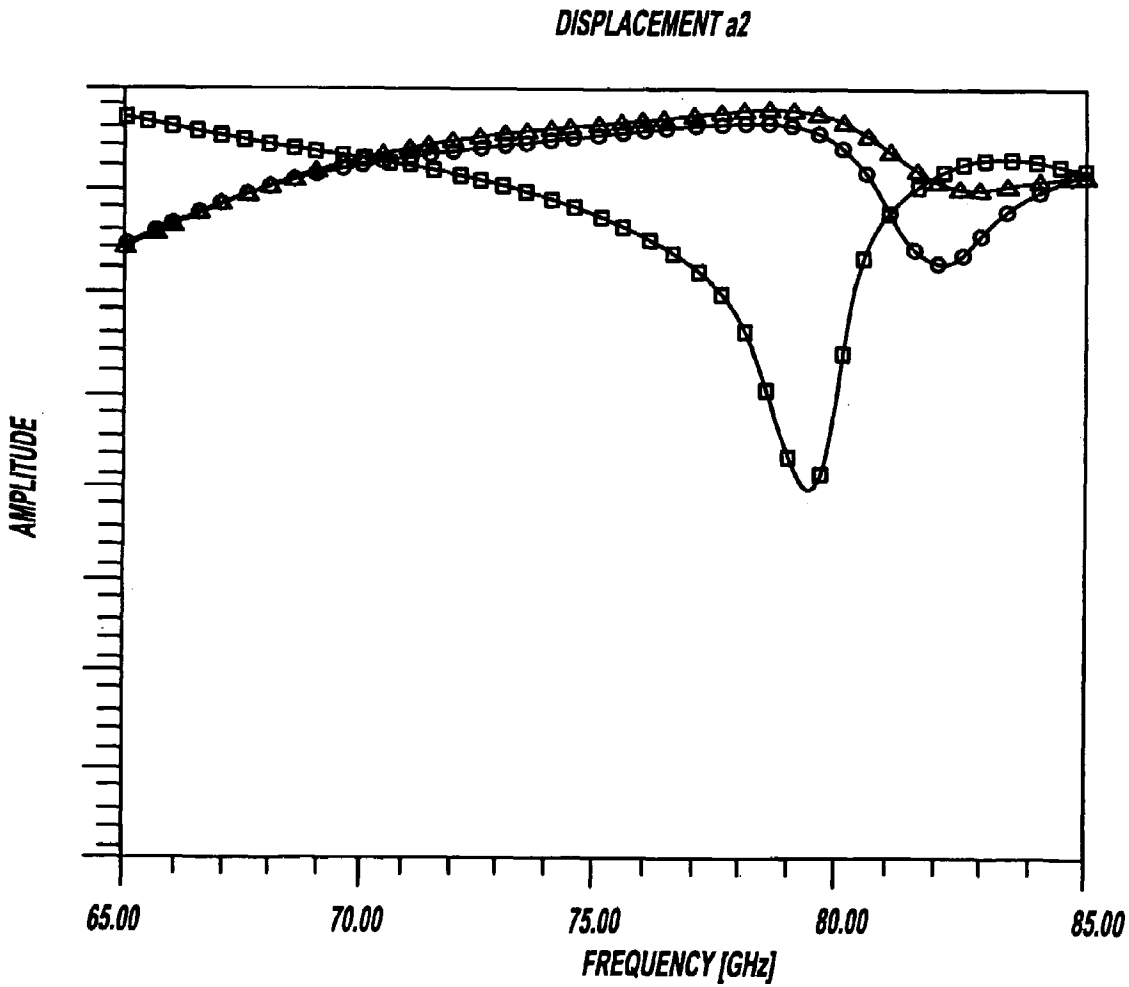
FIG - 4c Prior Art
Figure 4D:
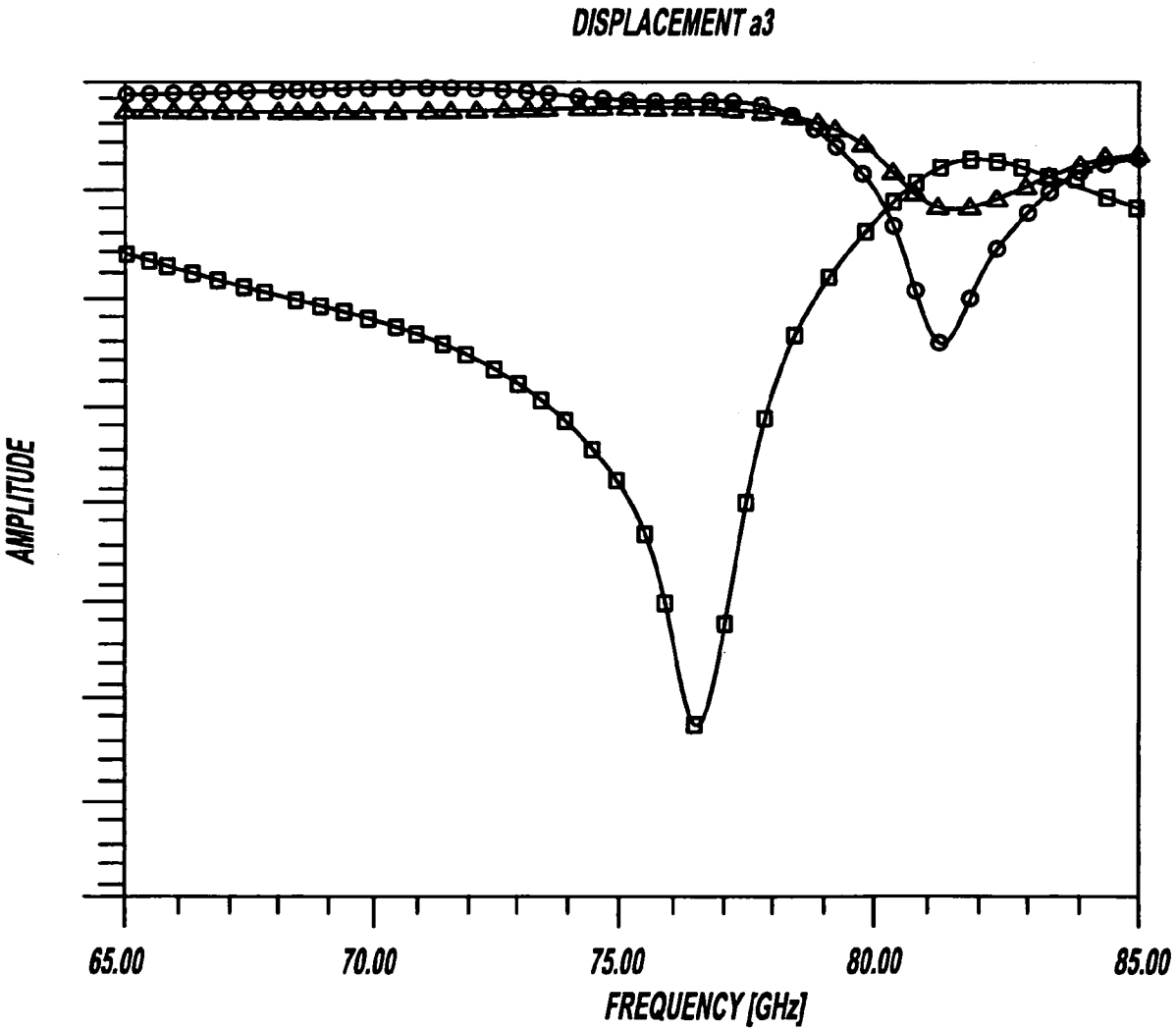
FIG - 4d Prior Art
Figure 10:
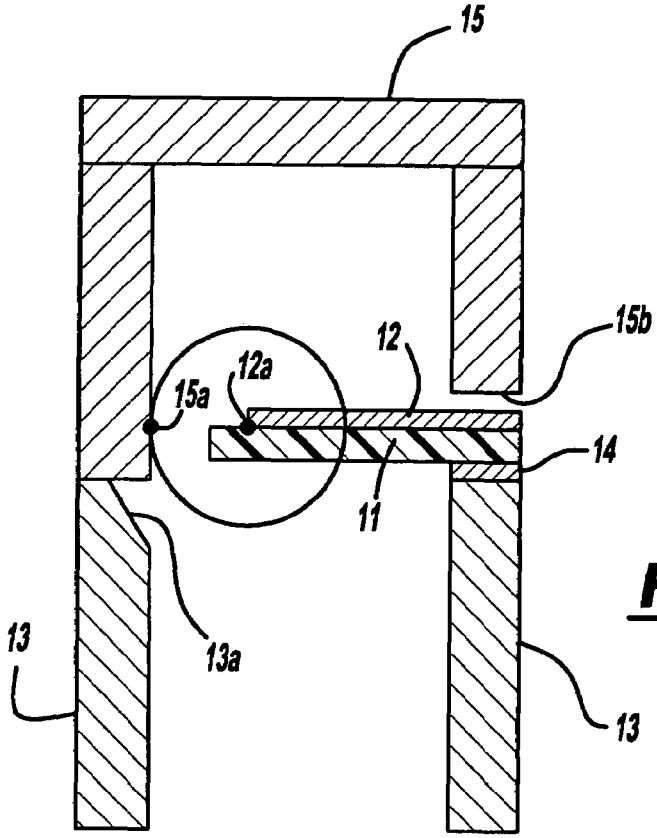
FIG. 10 is a cross-sectional view of a back-short waveguide-transmission line converter according to a second embodiment of the present invention.

FIG. 10 shows in cross section a back-short waveguide-transmission line converter according to a second embodiment of the present invention. The back-short waveguide-transmission line converter according to the second embodiment has structural details similar to those of the conventional patch-resonator waveguide-transmission line converter shown in FIGS. 2(*a*), 2(*c*), and 2(*d*). For those similar structural details, therefore, reference should be made to FIGS. 2(*a*), 2(*c*), and 2 (*d*).

As shown in FIG. 10, the back-short waveguide-transmission line converter according to the second embodiment has a dielectric substrate 11, a stripline 12 mounted on the dielectric substrate 11, a waveguide 13 connected to the dielectric substrate 11 with a ground metal layer 14 interposed therebetween, and a short-circuit waveguide block 15 mounted on the waveguide 13.

The dielectric substrate 11 is of an elongate rectangular shape, and the stripline 12 is disposed on one surface (face side) of the dielectric substrate 11. The stripline 12 extends perpendicularly to one side of the dielectric substrate 11, i.e., extends from one side of an open end of the waveguide 13 which is of a hollow shape inwardly into the opening of the waveguide 13.

The waveguide 13 of a hollow shape has a hollow space defined therein. The waveguide 13 has an elongate rectangular cross-sectional shape across its axis which extends vertically in FIG. 10. The dielectric substrate 11 with the stripline 12 mounted thereon is fixedly mounted on an open end of waveguide 13 and extends from one side wall of the waveguide 13 and terminates short of the opposite side wall of the waveguide 13. The dielectric substrate 11 is sandwiched between the waveguide 13 and the short-circuit waveguide block 15.

The waveguide 13 has opposite side walls which are basically of a substantially constant thickness. However, the side wall of the waveguide 13 which confronts the side wall thereof on which the dielectric substrate 11 is mounted has an thinner portion near the open end to which the short-circuit waveguide block 15 is fixed. Therefore, the hollow space in the waveguide 13 is greater in size at the thinner portion of the side wall thereof than at the other portion of the side wall. Specifically, an inner corner of the side wall of the waveguide 3 that is positioned near one longitudinal side of the waveguide 13 on which the short-circuit waveguide block 15 is disposed at the open end of the waveguide 3 is beveled such that the inner corner of the side wall is tapered toward the short-circuit waveguide block 15, providing a tapered inner surface 13*a*.

The ground metal layer 14 is in the form of a narrow strip having a width which is substantially the same as the thickness of the side wall of the waveguide 13 which is opposite to the side wall with the tapered inner surface 13*a*. The ground metal layer 14 is disposed on the surface (reverse side) of the dielectric substrate 11 remote from the surface (face side) thereof on which the stripline 12 is mounted. The dielectric substrate 11 is securely fixed to one side of the open end of the waveguide 13 with the ground metal layer 14 interposed therebetween.

The short-circuit waveguide block 15 comprises a cup-shaped member having the same cross-sectional shape as the waveguide 13, and is fixed to the waveguide 13 as by welding. The short-circuit waveguide block 15 has a recess 15*b* defined centrally in the lower edge of a side wall thereof. The recess 15*b* is large enough to accommodate therein the transverse dimensions of the dielectric substrate 11 with the stripline 12 mounted thereon. When the short-circuit waveguide block 15 is mounted on the waveguide 13, the stripline 12 is placed in the recess 15*b*.

Figure 11:
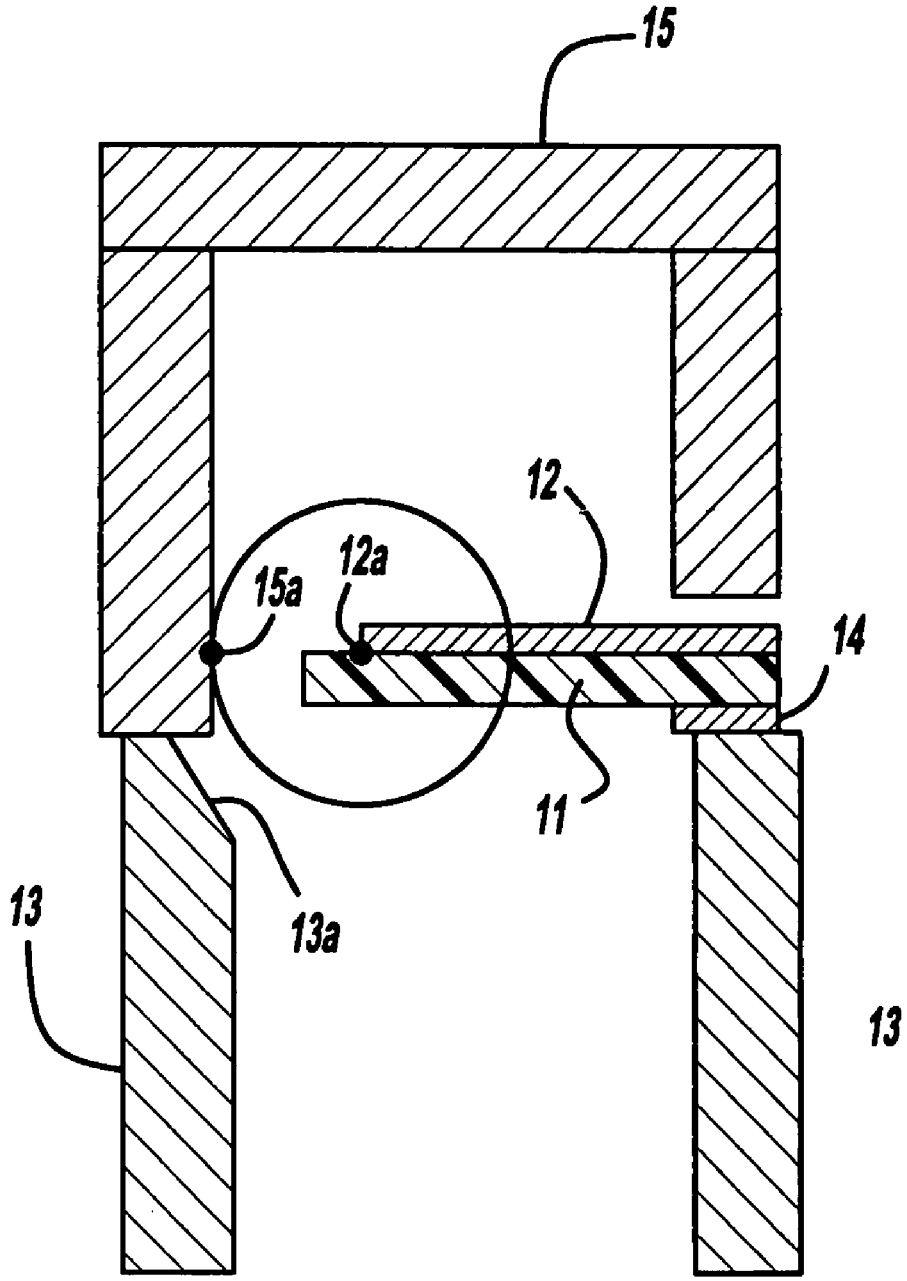
FIG. 11 is a cross-sectional view showing an assembling error that occurs on the back-short waveguide-transmission line converter shown in FIG. 10 when a dielectric substrate is assembled out of alignment with a waveguide.
Figure 12A:
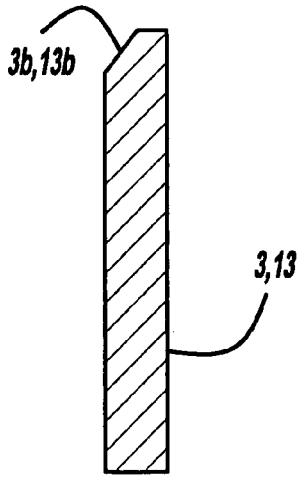
FIGS. 12(*a*) through 12(*e*) are cross-sectional views of side walls of various waveguides according to modifications of the present invention.
Figure 12B:
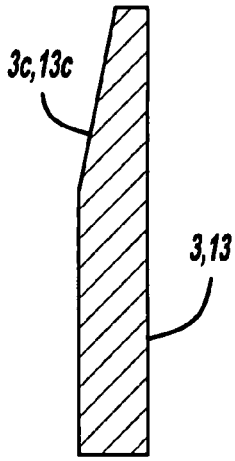
Figure 12C:
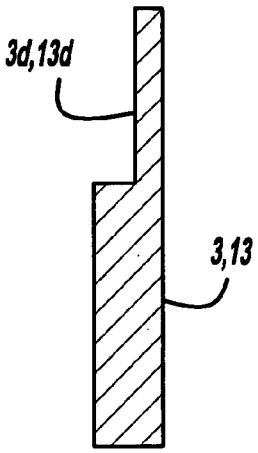
Figure 12D:
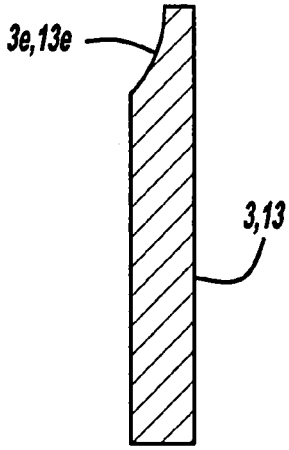
Figure 12E:
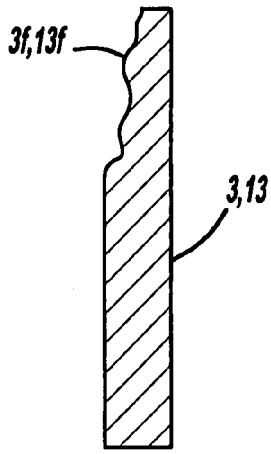

FIG. 11 shows in cross section an assembling error that occurs on the back-short waveguide-transmission line converter shown in FIG. 10 when the dielectric substrate 11 is assembled out of alignment with the waveguide 13. As shown in FIG. 11, when the dielectric substrate 11 and the waveguide 13 are assembled together, the dielectric substrate 11 is possibly displaced out of alignment with the waveguide 13 due to an assembling error.

Even if the dielectric substrate 11 is assembled out of alignment with the waveguide 13, however, since the inner corner of one of the side walls of the waveguide 13 at the open end thereof is beveled or tapered, the stripline 12 has an inner edge 12*a* spaced a certain distance from tapered inner surface 13*a* of the side wall of the waveguide 13 at the open end thereof. Consequently, no undue electric field concentration occurs between the stripline 12 and the waveguide 13 as they are relatively widely spaced apart, and hence the short-circuit waveguide-transmission line converter has electromagnetic energy passing and reflecting characteristics prevented from varying.

According to the second embodiment, since a sharp corner is eliminated from one of the side walls of the waveguide 13 at the opening end thereof by the tapered inner surface 13*a* of the side wall of the waveguide 13, an undue electric field concentration can be prevented from occurring simply by the tapered inner surface 13*a*. However, for better electromagnetic energy passing and reflecting characteristics, a circle having a radius equal to the distance from the inner edge 12*a* of the stripline 12 to a closest surface portion 15*a* (see FIG. 10) on the side wall, which is opposite to the side wall 15 is drawn about the edge 12*a* of the stripline 12, and the tapered inner surface 13*a* of the waveguide 13 is positioned outside of the circle, i.e., is spaced from the center of the circle by a distance greater than the radius. The inner corner of the side wall of the waveguide 3 at the opening end thereof is beveled to satisfy the above positional relationship even when the edge 12*a* of the stripline 12 is closest to the tapered inner surface 13*a* of the waveguide 13 due to a maximum possible displacement or distance by which the dielectric substrate 11 is displaced out of the alignment with the waveguide 13 due to an assembling error.

Modifications:

In the first and second embodiments, each of the waveguides 3, 13 includes a side wall having a tapered inner surface 3*a*, 13*a* produced by beveling an inner corner. However, the side wall of each of the waveguides 3, 13 may have a steeply tapered inner surface 3*b*, 13*b* as shown in FIG. 12(*a*) or a gradually tapered inner surface 3*c*, 13*c* as shown in FIG. 12(*b*). Alternatively, the side wall of each of the waveguides 3, 13 may have a right-angularly stepped inner surface 3*d*, 13*d* as shown in FIG. 12(*c*), an arcuately concave inner surface 3*e*, 13*e* as shown in FIG. 12(*d*), or an irregularly concave inner surface 3*f*, 13*f* as shown in FIG. 12(*e*).

In each of the above embodiments, each of the waveguides 3, 13 has an elongate rectangular cross-sectional shape. However, each of the waveguides 3, 13 may have a rectangular cross-sectional shape, such as a square cross-sectional shape, or an elongate rectangular cross-sectional shape with round four corners or a rectangular cross-sectional shape with round four corners.

In the first embodiment, the inner corners of the side walls of the waveguide 3 that are positioned near one longitudinal side of the waveguide 3 on which the stripline 2 is disposed and a confronting opposite longitudinal side of the waveguide 3 are beveled. In the second embodiment, the inner corner of the side wall of the waveguide 13 that is positioned near one longitudinal side of the waveguide 13 which confronts the longitudinal side thereof on which the stripline 2 is disposed is beveled. However, all the inner corners of the side walls of the waveguides 3, 13 that are positioned near all the sides of the waveguides 3, 13 which surround the opening thereof may be beveled.

Although certain preferred embodiments of the present invention have been shown and described in detail, it should be understood that various changes and modifications may be made therein without departing from the scope of the appended claims.

What is claimed is:

1. A waveguide-transmission line converter comprising:

a waveguide having a hollow shape with a hollow space defined therein;

a dielectric substrate disposed on an open end of said waveguide;

a strip line disposed on a surface of said dielectric substrate remote from said waveguide and extending inwardly from an outer side of said waveguide toward an opposite outer side of said waveguide;

a ground metal layer disposed on a surface of said dielectric substrate remote from said surface thereof on which said stripline is disposed, said ground metal layer extending along an outer edge of said dielectric substrate; and a matching element disposed on said surface of said dielectric substrate on which said ground metal layer is disposed, said matching element being spaced inwardly from said ground metal layer away from said outer edge of said dielectric substrate;

said dielectric substrate being mounted on said open end of said waveguide with said ground metal layer interposed therebetween, whereby said waveguide-transmission line converter is able to convert electromagnetic energy transmitted by said waveguide and electromagnetic energy transmitted by said stripline into each other;

wherein said waveguide has a beveled inner corner of a side wall thereof at the open end of the waveguide, and said hollow space is greater in size at said beveled inner corner than another portion of the side wall of the waveguide.

2. A waveguide-transmission line converter according to claim 1, wherein said beveled inner corner of the side wall of the waveguide includes a first bevel positioned near said outer side of said waveguide at the open end of said waveguide, and a second bevel which is positioned near an opposite outer side of said waveguide at the open end of the waveguide.

3. A waveguide-transmission line converter according to claim 1, wherein a circle having a radius equal to the distance from an edge of said matching element to an edge of said ground metal layer is drawn about said edge of said matching element, and said beveled inner corner of said waveguide has a surface spaced from said edge of said matching element by a distance greater than the radius of said circle.

4. A waveguide-transmission line converter according to claim 1, wherein said beveled inner corner comprises a tapered surface.

5. A waveguide-transmission line converter according to claim 1, wherein said beveled inner corner comprises a right-angularly stepped surface.

6. A waveguide-transmission line converter according to claim 1, wherein said beveled inner corner comprises an arcuately concave surface.

7. A waveguide-transmission line converter according to claim 1, wherein said beveled inner corner comprises an irregularly concave surface.

8. A waveguide-transmission line converter comprising:

a waveguide having a hollow shape with a hollow space defined therein;

a short-circuit waveguide block disposed on an open end of said waveguide;

a dielectric substrate fixedly disposed between the open end of said waveguide and said short-circuit waveguide block and sandwiched between said waveguide and said short-circuit waveguide block;

a stripline disposed on a surface of said dielectric substrate remote from said waveguide and extending inwardly from an outer side of said waveguide toward an opposite outer side of said waveguide; and a ground metal layer disposed on a surface of said dielectric substrate remote from said surface thereof on which said stripline is disposed, said ground metal layer extending along an outer edge of said dielectric substrate;

said dielectric substrate being mounted on said open end of said waveguide with said ground metal layer interposed therebetween, whereby said waveguide-transmission line converter can convert electromagnetic energy transmitted by said waveguide and electromagnetic energy transmitted by said stripline into each other;

wherein said waveguide has a beveled inner corner of a side wall thereof at the open end of the waveguide, and said hollow space is greater in size at said beveled inner corner than another portion of the side wall of the waveguide.

9. A waveguide-transmission line converter according to claim 8, wherein said beveled inner corner of the side wall of the waveguide is positioned near the outer side of said waveguide at the open end of said waveguide.

10. A waveguide-transmission line converter according to claim 8, wherein a circle having a radius equal to the distance from an edge of said stripline to a closest surface portion of said short-circuit waveguide block is drawn about said edge of said stripline, and said beveled inner corner of said waveguide has a surface spaced from said edge of said stripline by a distance greater than the radius of said circle.

11. A waveguide-transmission line converter according to claim 8, wherein said beveled inner corner comprises a tapered surface.

12. A waveguide-transmission line converter according to claim 8, wherein said beveled inner corner comprises a right-angularly stepped surface.

13. A waveguide-transmission line converter according to claim 8, wherein said beveled inner corner comprises an arcuately concave surface.

14. A waveguide-transmission line converter according to claim 8, wherein said beveled inner corner comprises an irregularly concave surface.

15. A waveguide-transmission line converter for converting electromagnetic energy between a waveguide and a transmission line, comprising:

a waveguide having an open end;

a short-circuit waveguide block disposed on an open end of said waveguide;

a dielectric substrate fixedly disposed between the open end of said waveguide and said short-circuit waveguide block, said dielectric substrate having a first surface facing away from said waveguide and a second surface facing toward said waveguide;

a stripline disposed on said first surface of the dielectric substrate and extending from an edge of the dielectric substrate toward an interior region on the surface of the dielectric substrate; and a ground metal layer disposed on said second surface of the dielectric substrate, said ground metal layer extending along an outer edge of said dielectric substrate;

said dielectric substrate being mounted on said open end of said waveguide with said ground metal layer interposed therebetween;

wherein said waveguide has a side wall having a tapered inner surface at the open end thereof.

16. A waveguide-transmission line converter according to claim 15, wherein said tapered inner surface is spaced from a closest edge of said stripline by a distance greater than the distance between said closest edge of said stripline and a surface portion of said short-circuit waveguide block which is closest to said stripline.

* * * * *